United States Patent [19]

Träger et al.

[11] Patent Number: 4,867,227

[45] Date of Patent: Sep. 19, 1989

[54] PROCESS AND APPARATUS FOR INOCULATING CAST IRON

[75] Inventors: Heiner Träger, Büdingen; Karl-Heinz Kleemann, Münster; Karl J. Reifferscheid, Karben, all of Fed. Rep. of Germany; Dieter H. Gumbinger, Marietta, Ga.

[73] Assignee: Metallgesellschaft Aktiengesellschaft, Frankfurt, Fed. Rep. of Germany

[21] Appl. No.: 227,630

[22] Filed: Aug. 2, 1988

[30] Foreign Application Priority Data

Aug. 7, 1987 [DE] Fed. Rep. of Germany ..... 3726272

[51] Int. Cl.[4] ..... B22D 27/20

[52] U.S. Cl. ..... 164/59.1; 164/58.1

[58] Field of Search ..... 164/55.1, 56.1, 57.1, 164/58.1, 59.1, 332, 349

[56] References Cited

U.S. PATENT DOCUMENTS 3,961,663 6/1976 Degois et al. ..... 164/58.1

FOREIGN PATENT DOCUMENTS 1248239 8/1967 Fed. Rep. of Germany .

1936153 1/1977 Fed. Rep. of Germany .

59-137155 8/1984 Japan ..... 164/55.1

61-229462 10/1986 Japan ..... 164/55.1

*Primary Examiner*—Kuang Y. Lin

*Attorney, Agent, or Firm*—Herbert Dubno

[57] ABSTRACT

A process is described in which cast iron melt are inoculated in the mold. The cast iron melt flowing through the sprue or gate system of the mold is contacted in the mold with an inoculate body that is contained in the mold. In order to increase the rate of dissolution and to improve the results of inoculation, said body is mounted at both ends in mutually opposite recesses (core prints) in the wall of the sprue or gate system. In another embodiment, the flow area is constricted closely below the inoculating body.

6 Claims, 1 Drawing Sheet

PROCESS AND APPARATUS FOR INOCULATING CAST IRON

FIELD OF THE INVENTION

Our present invention relates to a process for inoculating cast iron and to an apparatus which includes a mold for this purpose.

BACKGROUND OF THE INVENTION

It is known to treat molten metal with additives in the mold. Published German Application 19 36 153 discloses a process for making cast iron which contains nodular graphite that has been added in the mold. The apparatus used in that known process comprises a horizontally extending runner, which is followed by a downwardly offset, rectangular chamber, which contains spaced apart, vertical partitions, which define a passage. The partitions ensure that the cast iron entering the chamber will thoroughly be mixed with the inoculant so that a large contact surface between the cast iron and the inoculant will be obtained.

French Pat. 2,034,907 discloses a process and an apparatus for treating molten metal. The apparatus comprises a vertical downsprue and a following one-piece runner, which communicates with a reaction chamber, which enlarges the cross section of the runner and contains the inoculant.

The apparatus which is known from German Patent Specification 24 10 109 and serves to make nodular cast iron comprises a downsprue, which is succeeded by a horizontal runner. The inoculant is contained in a shallow recess, which is formed in the bottom of the runner and does not interrupt the laminar flow.

Published German Application 19 01 366 discloses an apparatus for inoculating, alloying or treating molten metal to be cast. The sprue for receiving the molten metal and/or cavity to be filled by the molten material is provided with a body which is adapted to be dissolved by the molten material and contains a granular inoculant and/or/alloying elements. That body may be made from polystyrene foam, which has been enriched with inoculant.

Another process of inoculating cast iron is known from German Patent Publication 12 48 239 and comprises contacting molten cast iron flowing through the sprue or gate system with an inoculant which has been embedded in said system. The inoculant may consist of a shaped body or a tubular member. The known processes and apparatuses have not produced satisfactory results in all cases. The shaped bodies may not present sufficiently large surfaces to the inflowing melt for a dissolving action or undesired turbulence may be generated or undissolved particles of the treating agent may be detached and will then constitute inclusions in the casting or the economy may be low because an excessive quantity of undissolved treating agent remains in the sprue system of the mold.

OBJECTS OF THE INVENTION

It is an object of the invention to provide, for the inoculation of cast iron melts, a process in which a turbulence in the cast iron melt is substantially avoided and inoculant at an adequate rate is introduced into a flow which is as highly laminar as possible.

Another object is to provide an improved apparatus for carrying out the process.

SUMMARY OF THE INVENTION

In a process of inoculating a cast iron melt in a mold, wherein the cast iron melt flowing through the sprue or gate system of the mold is contacted in the mold with an inoculate body that is contained in the mold, these objects are accomplished in accordance with the invention in that the body is mounted at both ends in mutually opposite recesses or core prints in the wall of the sprue or gate system.

Because the inoculant body is mounted or supported at both ends in recesses formed in the wall or in so-called core prints, a reliable mounting of the body will be ensured even if the recess has a relatively low depth.

That mounting may be improved by an anchoring effected by an adhesive. The recesses or core prints are advantageously adapted to the shape of the inoculant body in such a manner that a virtually solid socket is formed for receiving the ends of the inoculant body so that an ingress of molten material into the gap between the mold and the inoculant body will virtually be prevented.

The socket-like recesses formed in the wall and mounting the innoculant body are advantageously disposed in the joint plane of the flask. In that case, the mold may be divided in a vertical or horizontal plane.

For the novel mounting, in accordance with the invention, the longitudinal axis of the inoculant body must be longer than its transverse axis. For instance, the bodies may consist of solid bars which are circular or cornered in cross-section and the bars may suitably be provided in the middle with elliptical or spherical enlarged portions.

In addition, the inoculant body may have the shape of a slender frustum of a cone. Particularly suitable inoculant bodies have a double conical or double pyramidal shape.

In accordance with a further feature, the inoculant body used in the process in accordance with the invention is not rotationally symmetrical, but is parallelpipedal and its end faces extend in the direction of flow of the cast iron melt.

In order to substantially avoid any turbulence, the sprue portion of the mold is adapted to the shape of the inoculant body so that desirable conditions will be obtained for the flow of the cast iron melt.

In other embodiment of the invention, the cast iron melt is restrained adjacent to the inoculant body so that said body is dissolved by restrained molten material in the sprue. In that case, the circular cross section of the sprue is constricted to a slop-shaped cross section closely below the inoculant body and the sprue is subsequently enlarged from said slot-shaped cross section to the original circular cross section.

Advantages are afforded by the process in accordance with the invention. In the inoculating process in accordance with the invention, the inoculant body is contacted virtually throughout its periphery by the flowing molten metal and only a relatively small part of each end portion is mounted in the wall and is covered by ceramic material.

Because the body is mounted at both ends, the bearing region may be relatively small so that a larger surface area of inoculant is presented per unit of weight of the flowing melt. Besides, the peripheral surface of the inoculant body need not bear under pressure on the wall in the core print (blind hole).

Compared to a unilateral mounting, the mounting at both ends will reliability prevent a fracture of the body because a torque will not be exerted by the flow pressure of the cast iron melt.

The process in accordance with the invention may be used in special advantage in the shell molding because the sockets can effectively be formed in the relatively thin walls of the shells (shell halves) and the inoculant body may be loosley inserted rather than pressed into the core prints in the pressure-sensitive shells so that an unnecessary rejection of destroyed shells will be avoided.

BRIEF DESCRIPTION OF THE DRAWING

These objects and others which will become more apparent hereinafter are attained, in accordance with the invention, reference being made to the accompanying drawing in which:

In FIGS. 1*a*, 1*b*, 2*a* and and 2*b*, we have shown, highly diagrammatically, a mold having a gate system which includes a sprue passage 2 and at least one gate passage extending downwardly from the sprue passage and connecting the sprue passage 2 to the mold cavity.

Figure 1A:
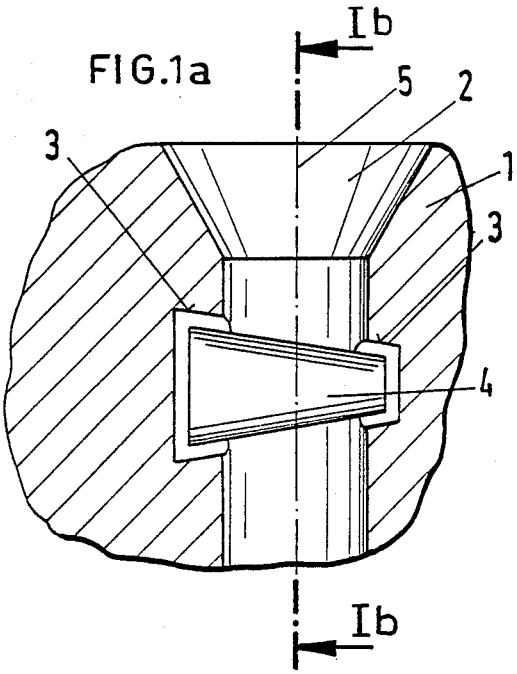
FIG. 1*a* is a vertical sectional view through a sprue passage of a mold having a vertically divided flask and hence a vertical joint plane.
Figure 1B:
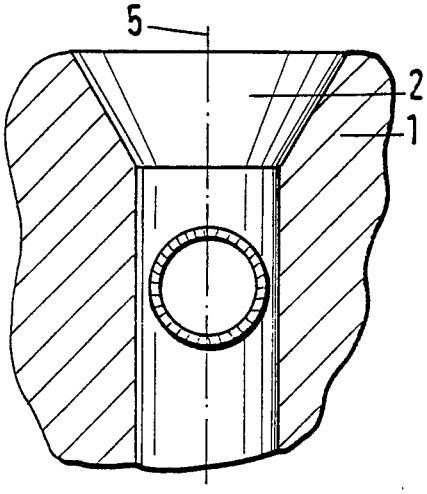
FIG. 1*b* is a section along line I*b*—I*b* of FIG. 1*a;*
Figure 2A:
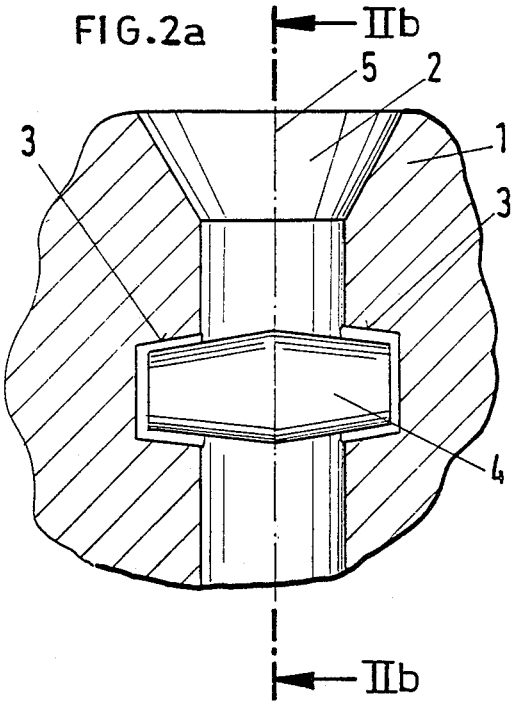
FIG. 2*a* is a vertical sectional view through a sprue passage of a mold having a vertically divided flask and hence a vertical joint plane of another embodiment.
Figure 2B:
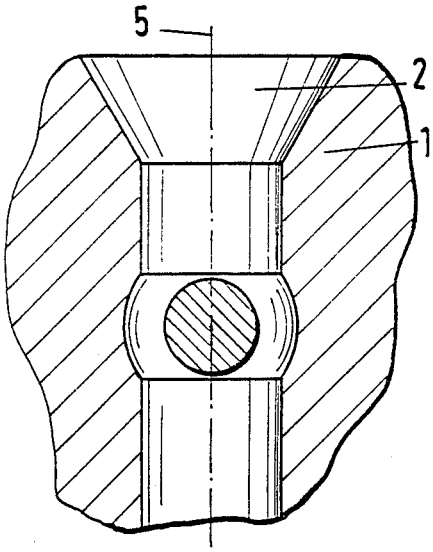
FIG. 2*b* is a section along line IIb-IIb of FIG. 2*a.*

On opposite sides of the gate passage, respective recesses 3 are located opposite one another and are in the form of core prints to receive opposite ends of the elongated inoculating body 4 which, as is clear from FIGS. 1*a* and 2*a*, can have its longitudinal axis perpendicular to the axis 5 of the passage. The longitudinal axis is, of course, greater than the transverse axis which can extend parallel to the axis 5.

SPECIFIC DESCRIPTION AND EXAMPLES

Example I (Prior Art)

To make crankshafts, cast iron comprising nodular graphite and composed of 3.75% C, 0.32% Mn, 0.6% Cu, 2.1% Si, 0.009% S and 0.042% Mg was poured into a vertically divided mold. The conventional in-mold inoculation was effected in the pouring cup of the mold means of a frustoconical inoculant body composed of 75% Si, 0.6% Ca, 1.8% Al, balance Fe, at a pouring temperature of 1395°. C. The weight of the melt which was poured, inclusive of the riser and the sprue system, amounted to 56 kg and the inoculant body weighed 63 g. The inoculant body was inserted into a core print in the pouring cup in about ⅓ of its height and was fixed. The sprue was covered with an iron sheet having a thickness of 2.5 mm so that the delay was effected which was required for the filling of the pouring cup and for the activation of the inoculant body. The mold was filled within 11 seconds. The metallurgical result of the inoculation was detected by an inspection of polished sections taken from the main-shaft of the shaft. The graphite nodules in the predominantly pearlitic matrix were found to have the following sizes:

| Structure | Spherulites per mm² | Size Distribution, Diameter in μm 60–80 | 40–60 | 20–40 | <20 |
|---|---|---|---|---|---|
| Up to about 3% cementite, about 15% ferrite, balance pearlite | 205 | 2.9% | 2.9% | 20.4% | 73.8% |

When the crankshafts which had been cast in batches in lots of 40 shafts were inspected, small cementite residues were detected in the structure in individual cases. For this reason, the crankshafts were subsequently subjected to a normalizing treatment in order to ensure a satisfactory structure. No improvement was achieved by other efforts made to ensure that the mainshaft of the crankshafts made under reproducible conditions was free of cementite by a change of arrangement of the inoculant body in the pouring cup.

Example II (Invention)

Crankshafts were also made in that cast iron comprising nodular graphite and composed of 3.75% C, 0.32% Mn, 0.6% Cu, 2.1% Si, 0.009 S and 0.042% Mg was poured at 1395° C. into a vertically divided mold. The melt was inoculated in the mold by means of an inoculated body having the composition stated in Example 1. For that purpose, the wall of the sprue was formed at a small distance below the pouring cup recesses, which were similar to core prints and the frustoconical or double frustoconical inoculant body (see FIGS. 1*a*–2*b*). was mounted with both journal-like end portions in said recesses.

Each of the two portions of the body which were mounted in the mutually opposite recesses has a length amounting to about ⅛ of the overall length of the body.

The circular cross-section of the sprue was constricted below the inoculant body to a slot-shaped cross section and was subsequently enlarged to the initial cross section so that the iron melt was restrained and the inoculant body was virtually disposed in the restrained melt and was able to dissolve approximately in proportion to the quantity of iron flowing through.

When inoculant bodies as shown in FIGS. 1*a*–2*b* were used, the time required to fill the mold amounted to 12 to 13 second, which was only slightly longer than in Example 1. The weight of the frustoconical body amounted to 63.8 g and that of the double frustoconical body to about 66.2 g. The two inoculant bodies had the same hemical composition as the inoculant body used in Example 1. Where the double frustoconical inoculant body was used which was mounted in recess of the sprue was a cementite-free structure was directly obtained and the graphite nodules had the distribution stated in the following Table. The metallurgical result of the inoculation was tested on a lot of 40 crankshafts. For that purpose, samples were taken from the mainshaft portions and polished sections were made therefrom for an inspection of the structure. The polished section was also etched for a detection of cementite.

| Structure | Spherulites per mm² | Size Distribution, Diameter in μm 60–80 | 40–60 | 20–40 | <20 |
|---|---|---|---|---|---|
| 20% ferrite balance pearlite, no cementite | 235 | — | 1.0% | 34.6% | 64.4% |

It is apparent from the Table that there are no spherulites in the largest dimeter range and that the average diameter of the nodules is smaller. Owing to that distinct improvement of the treatment with the inoculant, the casting consisting of the crankshaft had a higher fatigue strength under inversed bending stresses.

In addition to the inoculant alloy stated in the Examples, similar results were obtained by the use of inoculant alloys based on FeSi 45 and FeSi 60 and FeSi 90, which had been alloyed with inoculating elements such as strontium, calcium zirconium, barium, bismuth, and rare-earth metals, such as Ce, La and others.

We claim:

1. A process for inoculating a cast iron melt in a mold having a mold cavity, and a gate system having a sprue passage and at least one gate passage connecting said sprue passage to said mold cavity, comprising the steps of:

forming an elongated inoculate body composed of a material with which said melt is to be inoculated so that said body has a dimension along a longitudinal axis which is greater than its maximum dimension transverse to said longitudinal axis;

mounting said inoculate body composed of said material with which said melt is to be inoculated at opposite ends in respective recesses located opposite one another across one of said passages in a wall thereof so that said longitudinal axis extends across said one of said passages; and casting said melt into said mold cavity at least in part through said one of said passages and into contact with the outer surface of said body whereby said material of said body is dissolved in said melt.

2. The process defined in claim 1 wherein said recesses are shallow core prints formed in said wall.

3. The process defined in claim 1 wherein said body has at least a partly conical shape.

4. The process defined in claim 3, wherein said body has a conical shape.

5. The process defined in claim 3 wherein said body has a double-conical shape.

6. The process defined in claim 1 wherein a flow cross section of said one of said passages is restricted at the level of said body.

* * * * *